US010598045B2

(12) United States Patent
Tableau et al.

(10) Patent No.: US 10,598,045 B2
(45) Date of Patent: Mar. 24, 2020

(54) TURBINE RING ASSEMBLY

(71) Applicant: Safran Aircraft Engines, Paris (FR)

(72) Inventors: Nicolas Paul Tableau, Paris (FR); Sébastien Serge Francis Congratel, La Brosse Montceaux (FR); Clément Jean Pierre Duffau, Paris (FR); Lucien Henri Jacques Quennehen, Paris (FR)

(73) Assignee: Safran Aircraft Engines, Paris (FR)

( * ) Notice: Subject to any disclaimer, the term of this patent is extended or adjusted under 35 U.S.C. 154(b) by 251 days.

(21) Appl. No.: 15/680,924

(22) Filed: Aug. 18, 2017

(65) Prior Publication Data

US 2018/0051590 A1 Feb. 22, 2018

(30) Foreign Application Priority Data

Aug. 19, 2016 (FR) ..... 16 57827

(51) Int. Cl.
*F01D 25/28* (2006.01)
*F01D 25/24* (2006.01)
(Continued)

(52) U.S. Cl.
CPC ..... *F01D 25/28* (2013.01); *F01D 11/005* (2013.01); *F01D 11/08* (2013.01); *F01D 25/246* (2013.01);
(Continued)

(58) Field of Classification Search
CPC ..... F01D 25/28; F01D 11/005; F01D 11/08; F01D 25/246; F05D 2220/32; F05D 2240/11; F05D 2260/30; F05D 2300/6033
(Continued)

(56) References Cited

U.S. PATENT DOCUMENTS 4,596,116 A * 6/1986 Mandet ..... F01D 11/08 415/173.2
5,188,506 A * 2/1993 Creevy ..... F01D 11/005 277/643
(Continued)

FOREIGN PATENT DOCUMENTS

CA 2986285 A1 * 8/2018 ..... F01D 25/246
EP 1350927 A2 10/2003
(Continued)

OTHER PUBLICATIONS

Search Report for corresponding French Application No. 1657827, dated May 23, 2017 (2 pages).

*Primary Examiner* — J. Todd Newton
(74) *Attorney, Agent, or Firm* — Bookoff McAndrews, PLLC

(57) ABSTRACT

A turbine ring assembly includes ring sectors forming a turbine ring and a ring support structure, each ring sector having, in a section plane defined by an axial direction and a radial direction of the turbine ring, a portion forming an annular base with, in the radial direction, an inside face defining the inside face of the turbine ring and an outside face from which a first and a second attachment tab protrude, the ring support structure having a central annulus from which a first and a second radial tab protrude, between which the first and second attachment tabs of each ring sector are held. The first radial tab comprises a one-piece annular flange that is fastened in a removable manner to the central annulus of the ring support structure.

9 Claims, 4 Drawing Sheets

(51) Int. Cl.
*F01D 11/00* (2006.01)
*F01D 11/08* (2006.01)

(52) U.S. Cl.
CPC ..... *F05D 2220/32* (2013.01); *F05D 2240/11* (2013.01); *F05D 2260/30* (2013.01); *F05D 2300/6033* (2013.01)

(58) Field of Classification Search
USPC ..... 415/173.1
See application file for complete search history.

(56) References Cited

U.S. PATENT DOCUMENTS 5,988,975 A * 11/1999 Pizzi ..... F01D 11/005 415/139
7,374,395 B2 * 5/2008 Durocher ..... F01D 9/04 415/115
8,790,067 B2 * 7/2014 McCaffrey ..... F01D 11/18 415/1
2004/0047726 A1 * 3/2004 Morrison ..... F01D 9/04 415/116
2006/0292001 A1 * 12/2006 Keller ..... F01D 11/025 415/170.1
2007/0077141 A1 * 4/2007 Keller ..... F01D 11/08 415/136
2011/0182724 A1 * 7/2011 Koyabu ..... F01D 9/04 415/180
2012/0027572 A1 2/2012 Denece et al.
2012/0082540 A1 4/2012 Dziech et al.
2013/0156550 A1 * 6/2013 Franks ..... F01D 11/08 415/126
2014/0271145 A1 9/2014 Thomas et al.
2015/0226124 A1 * 8/2015 Tsutsumi ..... F01D 25/246 415/193
2015/0377069 A1 * 12/2015 Landwehr ..... F01D 25/28 415/1
2016/0169025 A1 * 6/2016 Lamusga ..... F01D 11/08 415/173.1
2016/0177759 A1 6/2016 Tuertscher et al.
2016/0319686 A1 * 11/2016 Shi ..... F23R 3/007
2016/0341055 A1 * 11/2016 Jenkins ..... F01D 11/001
2017/0101882 A1 * 4/2017 Sippel ..... F01D 11/08
2017/0298776 A1 * 10/2017 Rogers ..... F01D 11/08
2018/0051591 A1 * 2/2018 Quennehen ..... F01D 11/005
2018/0087401 A1 * 3/2018 Quennehen ..... F01D 11/08
2018/0156069 A1 * 6/2018 Quennehen ..... F01D 11/08
2019/0128132 A1 * 5/2019 Tableau ..... F01D 25/005

FOREIGN PATENT DOCUMENTS

EP 2960440 A1 12/2015
FR 2540939 A1 8/1984
FR 2955898 8/2011
GB 2480766 11/2011
WO WO 2006/136755 A2 12/2006
WO WO-2015047478 A2 * 4/2015 ..... F01D 11/18
WO WO 2015/191174 A1 12/2015
WO WO-2015191174 A1 * 12/2015 ..... F01D 11/08
WO WO-2016146932 A1 * 9/2016 ..... F01D 25/246

* cited by examiner

TURBINE RING ASSEMBLY

CROSS-REFERENCE TO RELATED APPLICATIONS

This patent application claims priority to French Patent Application No. 1657827, filed Aug. 19, 2016, which is incorporated herein by reference in its entirety.

FIELD

The invention relates to a turbine ring assembly comprising a plurality of ring sectors made of ceramic matrix composite material and also a ring support structure.

The field of application of the invention is notably that of gas turbine aeronautical engines. However, the invention is applicable to other turbomachines, for example industrial turbines.

BACKGROUND

In the case of entirely metal turbine ring assemblies, it is necessary to cool all of the elements of the assembly and in particular the turbine ring which is subjected to the hottest flows. This cooling has a significant impact on the performance of the engine since the cooling flow used is taken from the main flow of the engine. Furthermore, the use of metal for the turbine ring limits the possibilities of increasing the temperature at the turbine, although this would make it possible to improve the performance of aeronautical engines.

In an attempt to solve these problems, it has been envisioned to produce turbine ring sectors from ceramic matrix composite (CMC) material in order to do away with the use of a metal material.

CMC materials have good mechanical properties, making them able to form structural elements, and beneficially retain these properties at high temperatures. The use of CMC materials has beneficially made it possible to reduce the cooling flow to be imposed during operation and thus to enhance the performance of the turbomachines. Furthermore, the use of CMC materials makes it possible beneficially to reduce the mass of the turbomachines and to reduce the heat expansion effect encountered with metal parts.

However, the existing solutions proposed can employ an assembly of a CMC ring sector with metal attachment parts of a ring support structure, these attachment parts being subjected to the hot flow. Consequently, these metal attachment parts undergo heat expansion, and this can result in the CMC ring sectors being mechanically stressed and weakened.

Furthermore, the documents FR 2 540 939, GB 2 480 766, EP 1 350 927, US 2014/0271145, US 2012/082540 and FR 2 955 898, which disclose turbine ring assemblies, are known.

There is a need to improve the existing turbine ring assemblies and the mounting thereof, and notably the existing turbine ring assemblies that use a CMC material, in order to reduce the intensity of the mechanical stresses to which the CMC ring sectors are subjected during operation of the turbine.

SUMMARY

An aspect of the invention seeks to propose a turbine ring assembly that makes it possible for each ring sector to be held deterministically, that is to say such that its position can be controlled and to avoid a situation in which it starts to vibrate while, for the one part, allowing the ring sector, and by extension the ring, to deform under the effects of increases in temperature and variations in pressure, notably independently of the interfacing metal parts, and, for the other part, improving sealing between the sector outside the air passage and the sector in the air passage and simplifying manipulations and reducing the number thereof for mounting the ring assembly.

An embodiment of the invention provides a turbine ring assembly comprising a plurality of ring sectors forming a turbine ring and a ring support structure, each ring sector having, in a section plane defined by an axial direction and a radial direction of the turbine ring, a portion forming an annular base with, in the radial direction of the turbine ring, an inside face defining the inside face of the turbine ring and an outside face from which a first and a second attachment tab protrude, the ring support structure having a central annulus from which a first and a second radial tab protrude, between which the first and second attachment tabs of each ring sector are held.

According to one general feature of the invention, the first radial tab comprises a one-piece annular flange that is fastened in a removable manner to the central annulus of the ring support structure, the annular flange having a free first end, a second end coupled to the central annulus of the annular support structure, and at least one attachment hook that protrudes from the second end of the annular flange and engages with at least one compartment included in the central annulus of the ring support structure in order to hold the annular flange in position.

In one particular embodiment, the ring sectors can be made of ceramic matrix composite material.

The removable nature of the annular flange makes it possible to have axial access to the cavity of the turbine ring. This makes it possible to join the ring sectors together outside the ring support structure and subsequently to axially slide the assembly assembled in this way into the cavity of the ring support structure until it butts against the second radial tab, before the annular flange is fastened to the central annulus of the ring support structure.

During the operation of fastening the turbine ring to the ring support structure, it is possible to use a tool comprising a cylinder or a ring against which the ring sectors are pressed or held by suction while they are being assembled in a ring.

The fact that there is a one-piece annular flange, that is to say one that describes an entire ring through 360°, makes it possible, compared with a sectored annular flange, to limit the passage of the air flow between the sector outside the air passage and the sector in the air passage, inasmuch as all inter-sector leaks are eliminated, and thus to control the sealing.

The solution defined above for the ring assembly thus makes it possible to hold each ring sector deterministically, that is to say to control its position and to avoid a situation in which it starts to vibrate, while improving sealing between the sector outside the air passage and the sector in the air passage, simplifying manipulations and reducing the number thereof for mounting the ring assembly, and allowing the ring to deform under the effects of temperature and pressure notably independently of the interfacing metal parts.

According to a first aspect of the turbine ring assembly, the annular flange comprises a first portion that extends from the first end and a second portion that extends between the first portion and the second end, the first portion comprising separate first and second tabs, the first tab bearing against the first attachment tab and the second tab being spaced apart from the first tab in the axial direction, the second tab being upstream of the first tab with respect to the direction of an air flow intended to pass through the turbine ring assembly.

The second tab of the removable annular flange is intended to take up the force of the high-pressure distributor, also known as HPD. This annular flange makes it possible to take up this force by deforming, for the one part, and by passing this force toward the casing line which is most mechanically robust, for the other part.

Specifically, leaving a space between the first tab and the second tab of the flange makes it possible to divert the force received by the second tab, upstream of the first tab, and to pass it directly toward the central annulus of the ring support structure via the second portion of the flange, without having an impact on the second tab of the flange. Since the second tab of the flange is not subjected to any force, the turbine ring is thus preserved from this axial force.

According to a second aspect of the turbine ring assembly, the annular flange comprises a first and a second attachment hook that protrude from the second end of the annular flange in the axial direction of the turbine ring and are spaced apart in the radial direction of the turbine ring, the central annulus of the ring support structure comprising two attachment compartments that engage with the first and second attachment hooks of the annular flange in order to hold the annular flange in position in the radial direction of the turbine ring.

The attachment of the removable annular flange to the central annulus makes it possible to maximize the contact area between the central annulus of the ring support structure and the annular flange, thereby limiting any leaks of air between the two parts.

According to a third aspect of the turbine ring assembly, the first and second attachment hooks of the annular flange have two different axial positions in the axial direction of the turbine ring.

Axially spacing the attachment hooks apart from one another makes it possible to limit the tilting of the annular flange and thus to optimize the transfer of the forces taken up by the second tab of the annular flange.

According to a fourth aspect of the turbine ring assembly, the ring assembly comprises, for each ring sector, at least three pegs for holding the ring sector radially in position, the first and second attachment tabs of each ring sector each comprising a first end integral with the outside face of the annular base, a free second end, at least three lugs for receiving the at least three pegs, at least two lugs protruding from the second end of one of the first and second attachment tabs in the radial direction of the turbine ring, and at least one lug protruding from the second end of the other attachment tab in the radial direction of the turbine ring, each receiving lug having an orifice for receiving a peg.

The lugs protruding radially from the free ends of the first and second attachment tabs make it possible to shift the holding zone of the attachment tabs with respect to the bearing zones contained between the two ends of the attachment tabs and intended to realize sealed contact with the removable annular flange, for the one part, and with the second radial tab, for the other part.

According to a fifth aspect of the turbine ring assembly, the second portion of the annular flange has orifices for receiving a peg, and the second tab of the ring support structure comprises an annular bracket having a first portion bearing against the second attachment tab, a second portion that is thinner than the first portion, and a third portion that is positioned between the first and the second portion and has orifices for receiving a peg.

Separating the zone for receiving the pegs and the bearing zones of the attachment tabs of the ring against the annular flange, for the one part, and against the annular bracket, for the other part, makes it possible to optimize sealing by reducing breaks in the bearing zone.

According to a sixth aspect of the turbine ring assembly, each ring sector may comprise rectilinear bearing surfaces that are mounted on the faces of the first and second attachment tabs in contact with the second annular bracket and the first annular flange, respectively.

Rectilinear bearing contacts make it possible to have controlled sealing zones. More specifically, having bearing contacts on radial planes makes it possible to do away with decambering effects in the turbine ring. This is because this alignment of the contact zones on parallel rectilinear planes makes it possible to preserve sealing lines in the event of tilting of the ring and to preserve the same contact zones both in the cold state and in the hot state.

In operation, the ring sectors tilt about an axis corresponding to the normal to the plane formed between the axial direction and the radial direction of the turbine ring. In the event of a curved bearing contact, as in the prior art, the tabs of the ring sectors are in contact with the ring support structure at only one or two points, whereas, in the present invention, the rectilinear bearing contacts of the tabs of each ring sector allow bearing contact over an entire line, thereby improving the sealing between the ring sectors and the ring support structure. In an embodiment, for each ring sector, the faces of the second annular bracket and of the first annular flange in contact with the first and second attachment tabs, respectively, comprise rectilinear bearing surfaces.

According to a seventh aspect of the turbine ring assembly, each rectilinear bearing surface may comprise a recessed groove along the entire length of the bearing surface and a seal fitted in the groove for improving sealing.

Another aspect of the invention also provides a turbomachine comprising a turbine ring assembly as defined above.

BRIEF DESCRIPTION OF THE DRAWINGS

The invention will be understood better from the following text, given by way of nonlimiting indication, with reference to the appended drawings, in which.

DETAILED DESCRIPTION

Figure 1:
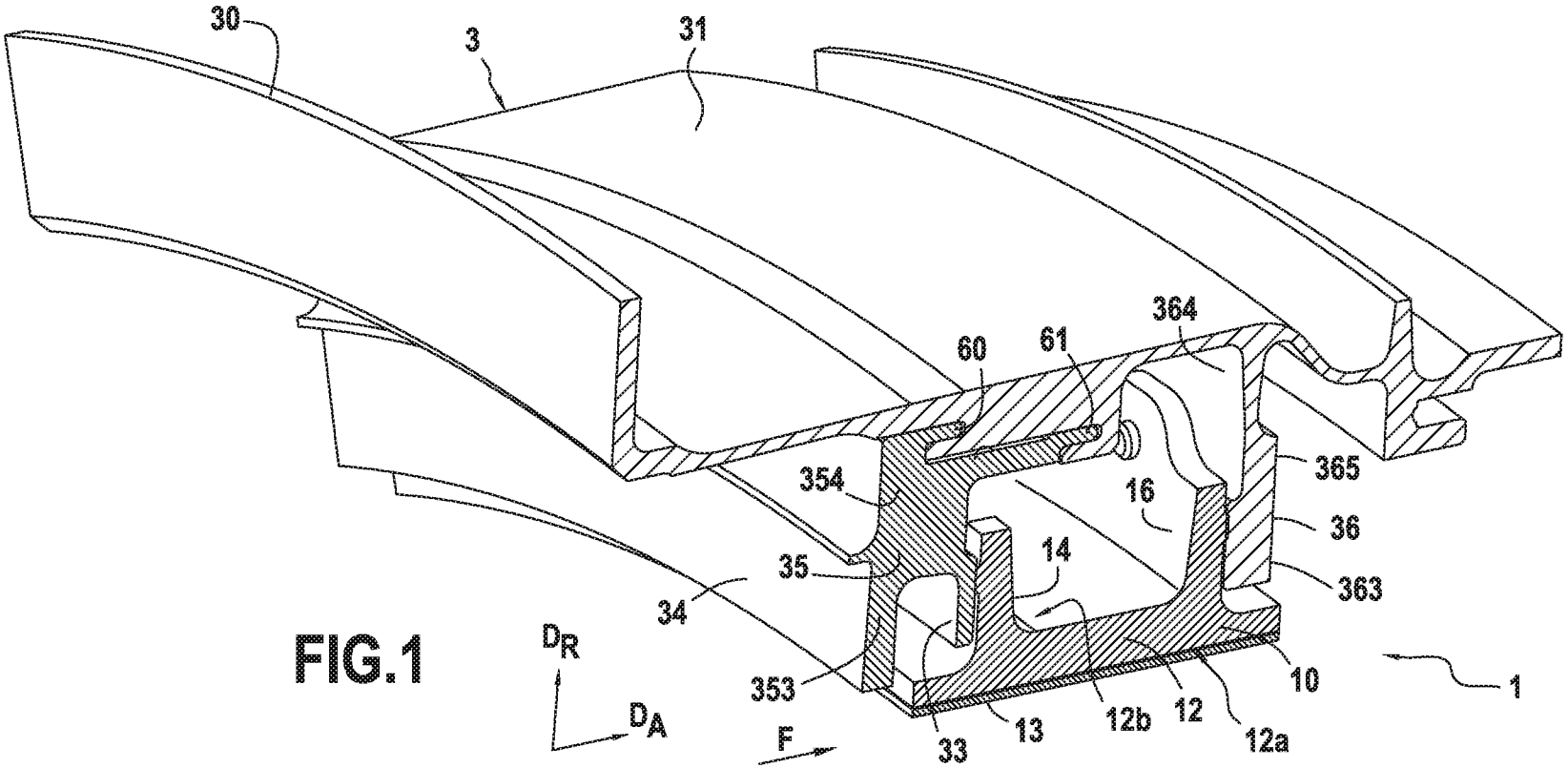
FIG. 1 is a first schematic perspective view of an embodiment of a turbine ring assembly according to the invention.

FIG. 1 shows a high pressure turbine ring assembly comprising a turbine ring 1 made of ceramic matrix composite (CMC) material and a metal ring support structure 3. The turbine ring 1 surrounds a set of rotary blades (not shown). The turbine ring 1 is formed from a plurality of ring sectors 10, FIG. 1 being a view in radial section. The arrow $D_A$ indicates the axial direction of the turbine ring 1, while the arrow $D_R$ indicates the radial direction of the turbine ring 1. For reasons of simplification of presentation, FIG. 1 is a partial view of the turbine ring 1, which is actually a complete ring.

Figure 2:
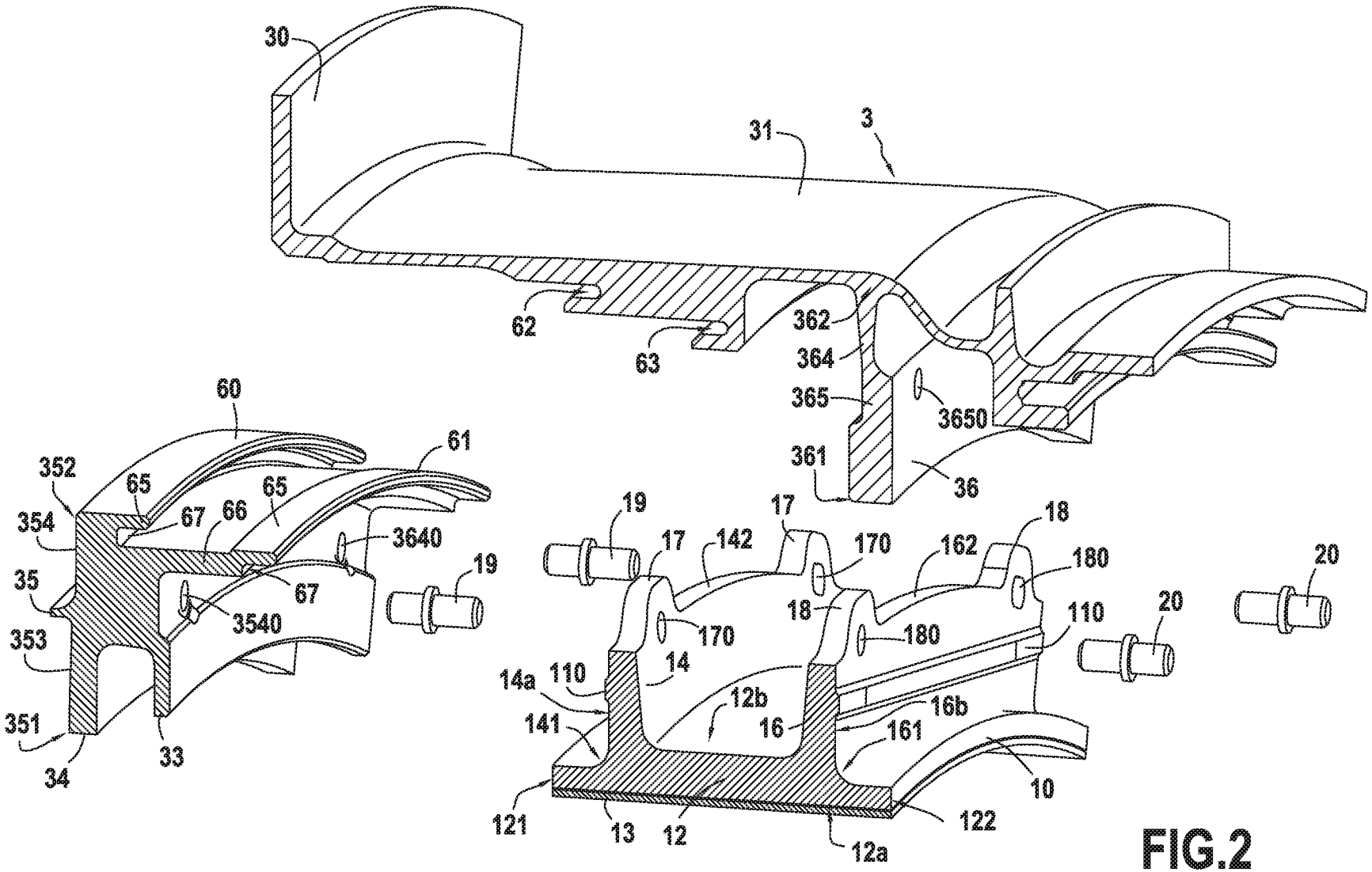
FIG. 2 is a first exploded schematic perspective view of the turbine ring assembly in FIG. 1.

As illustrated in FIG. 2, which shows an exploded schematic perspective view of the turbine ring assembly in FIG. 1, each ring sector 10 has, in a plane defined by the axial direction $D_A$ and radial direction $D_R$, a section substantially in the shape of an inverted Greek letter π. Specifically, the section comprises an annular base 12 and upstream and downstream radial attachment tabs, 14 and 16, respectively. The terms "upstream" and "downstream" are used here with reference to the direction of flow of the gaseous flow in the turbine indicated by the arrow F in FIG. 1. The tabs of the ring sector 10 could have some other shape, the section of the ring sector having a different shape than a π, for example a k shape.

In the radial direction $D_R$ of the ring 1, the annular base 12 has an inside face 12*a* and an outside face 12*b* on opposite sides from one another. The inside face 12*a* of the annular base 12 is covered with a layer 13 of abradable material that forms a thermal and environmental barrier and defines a flow passage for gaseous flow in the turbine.

The upstream and downstream radial attachment tabs 14 and 16 protrude, in the direction $D_R$, from the outside face 12*b* of the annular base 12 at a distance from the upstream and downstream ends 121 and 122 of the annular base 12. The upstream and downstream radial attachment tabs 14 and 16 extend across the entire width of the ring sector 10, that is to say over the entire circular arc described by the ring sector 10, or else along the entire circumferential length of the ring sector 10.

As is illustrated in FIGS. 1 and 2, the ring support structure 3, which is secured to a turbine casing 30, comprises a central annulus 31 that extends in the axial direction $D_A$ and has an axis of revolution coincident with the axis of revolution of the turbine ring 1 when they are fastened together, and also a removable annular flange 35 and an annular radial bracket 36, the removable annular flange 35 being positioned upstream of the annular radial bracket 36, which is thus located downstream of the removable annular flange 35.

As is illustrated in FIGS. 1 and 2, the annular radial bracket 36 extends in the circumferential direction of the ring 1 and, in the radial direction $D_R$, from the central annulus 31 toward the center of the ring 1. It comprises a free first end 361 and a second end 362 integral with the central annulus 31. The annular radial bracket 36 has a first portion 363, a second portion 364, and a third portion 365 contained between the first portion 363 and the second portion 364. The first portion 363 extends between the first end 361 and the third portion 365, and the second portion 364 extends between the third portion 365 and the second end 362. The first portion 363 of the annular radial bracket 36 is in contact with the downstream radial attachment tab 16. The second portion 364 is thinner than the first portion 363 and the third portion 365 so as to give the annular radial bracket 36 a degree of flexibility and thus not to stress the turbine ring 1 made of CMC excessively.

Figure 3:
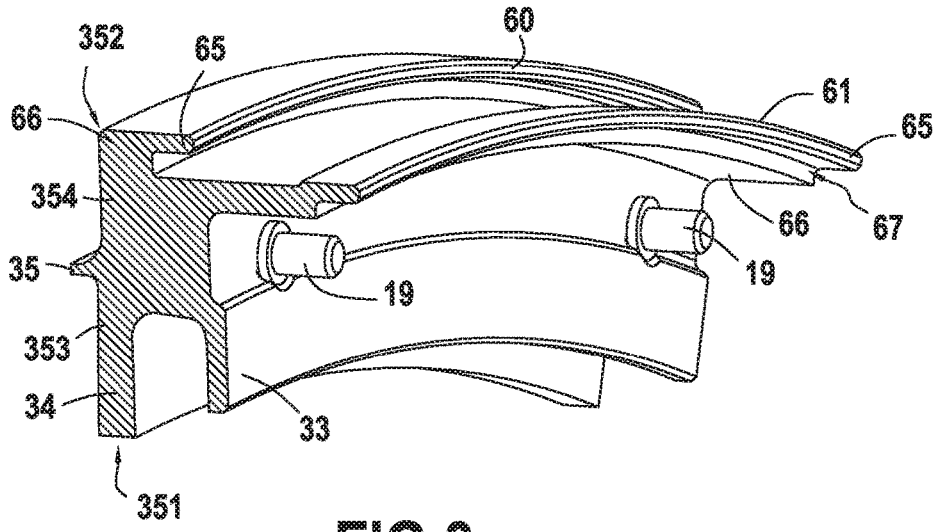
FIGS. 3 and 5 are a partial and a complete schematic perspective view, respectively, of the removable annular flange of the turbine ring assembly in FIG. 1.
Figure 5:
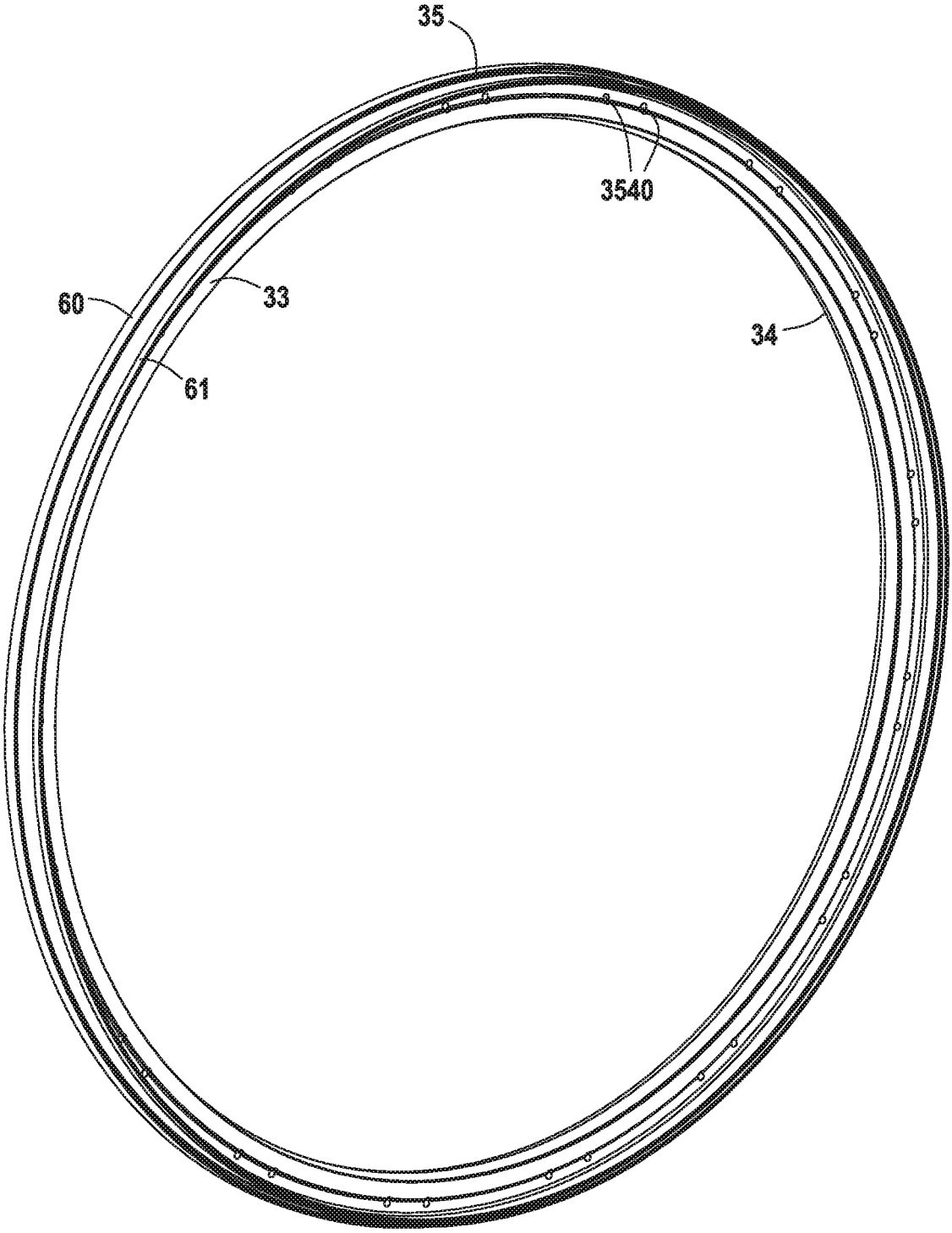

As is illustrated in FIGS. 1 and 2, and in FIG. 3, which shows a partial schematic perspective view of the removable annular flange 35 of the turbine ring assembly 1, and in FIG. 5, which shows a complete schematic perspective view of the removable annular flange 35, the removable flange 35 comprises a free first end 351 and a second end 352 intended to be coupled to the central annulus 31 of the annular support structure 3. The removable flange 35 also comprises a first portion 353 extending from the first end 351 and a second portion 354 extending between the first portion 353 and the second end 352. The first portion 353 comprises a first tab 33 and a second tab 34 separate from the first tab 33 and at a distance from the latter in the axial direction $D_A$, the second tab 34 being upstream of the first tab 33 with respect to the direction of the air flow, indicated by the arrow bearing the reference letter F, intended to pass through the turbine ring assembly 1. When the ring assembly has been mounted, the first tab 33 of the removable flange 35 is in abutment against the upstream radial attachment tab 14 of each of the ring sectors 10 that make up the turbine ring 1.

Figure 4:
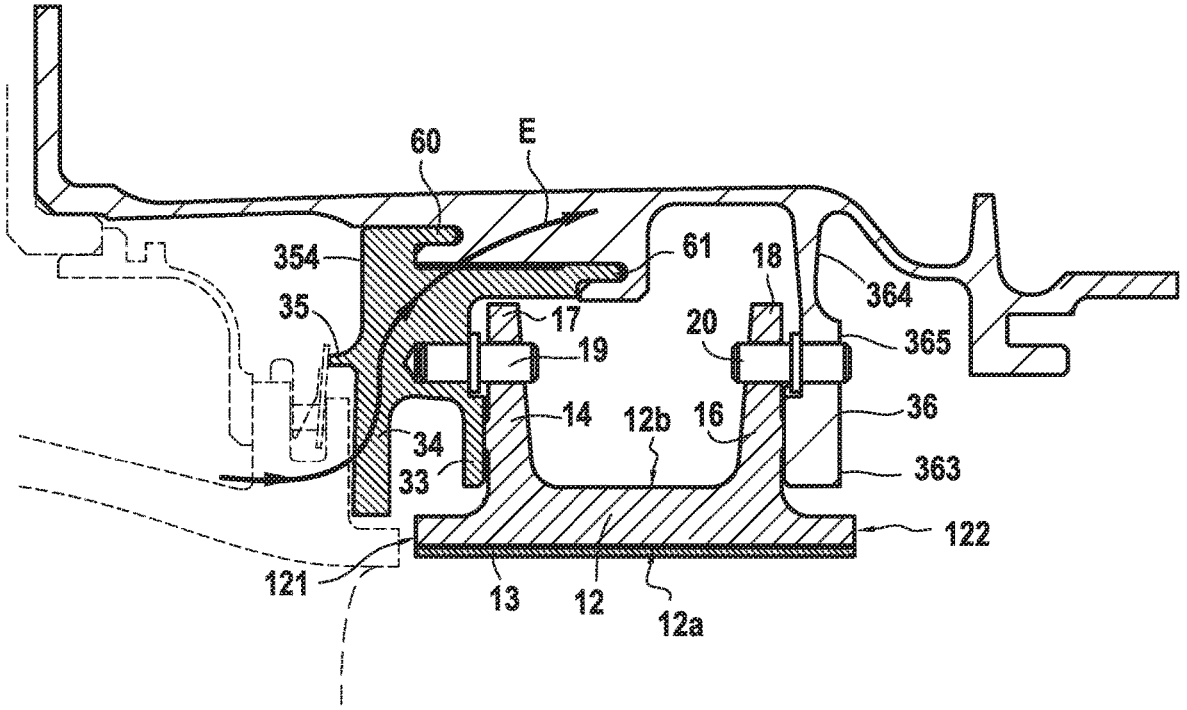
FIG. 4 is a schematic sectional view of the turbine ring assembly in FIG. 1.

The second tab 34 of the removable annular flange 35 is intended to take up the force of the high pressure distributor (HPD) on the removable annular flange 35 by deforming, for the one part, and by passing this force toward the casing line which is most mechanically robust, for the other part, that is to say toward the line of the ring support structure 3, as is illustrated by the force arrows E shown in FIG. 4, which is a cross-sectional view of the turbine ring assembly in FIG. 1 in a plane comprising the axial direction $D_A$ of the turbine ring 1 and the radial direction $D_R$ of the turbine ring 1.

The first tab 33 and the second tab 34 of the removable annular flange 35 meet at the second portion 354 of the removable annular flange 35.

In order to fasten the removable annular flange 35 to the central annulus 31 of the ring support structure 3, the second end 352 of the removable annular flange 35 comprises a first and a second attachment hook 60 and 61, and the central annulus 31 comprises a first and a second corresponding compartment 62 and 63.

The first and the second attachment hook 60 and 61 are disposed in two different positions in the radial direction $D_R$ of the turbine ring 1 and in two different positions in the axial direction $D_A$ of the turbine ring 1. The associated compartments 62 and 63 are realized in the central annulus 31 in a corresponding manner so as to engage with the first and the second attachment hook 60 and 61, respectively, in order to hold the removable annular flange 35 with the rest of the ring support structure 3.

In the embodiment illustrated, the first and the second attachment hook 60 and 61 each have a distal portion 65, such as a tongue, protruding from a proximal portion 66. The distal portion 65 is shaped to be inserted into the corresponding compartment 62 and 63 and to form, with the proximal portion 66, a shoulder 67 against which the contour of each compartment 62 and 63 bears in order to prevent any tilting of the removable annular flange 35 in the radial direction $D_R$ of the turbine ring 1 and notably in the direction toward the center of the turbine ring 1.

In the opposite direction, any tilting of the removable annular flange 35 is prevented by the proximal portion 66 and the distal portion 65 of the attachment hooks 60 and 61 having a direct contact surface, in the radial direction $D_R$ and in the opposite direction to the direction toward the center of the turbine ring 1, with the central annulus 31 of the ring support structure 3.

In the axial direction $D_A$, the annular radial bracket 36 of the ring support structure 3 is separated from the first tab 33 of the removable annular flange 35 by a distance corresponding to the spacing of the upstream and downstream radial attachment tabs 14 and 16 so as to hold the latter between the annular radial bracket 36 and the first tab 33 of the removable annular flange 35.

In order to hold the ring sectors 10, and thus the turbine ring 1, in position with the ring support structure 3, the ring assembly comprises two first pegs 19 that engage with the upstream attachment tab 14 and the removable annular flange 35, and two second pegs 20 that engage with the downstream attachment tab 16 and the annular radial bracket 36.

For each corresponding ring sector 10, the second portion 354 of the removable annular flange 35 comprises two orifices 3540 for receiving the two first pegs 19, and the third portion 365 of the annular radial bracket 36 comprises two orifices 3650 that are configured to receive the two second pegs 20.

For each ring sector 10, each of the upstream and downstream radial attachment tabs 14 and 16 comprises a first end, 141 and 161, integral with the outside face 12*b* of the annular base 12, and a free second end, 142 and 162. The second end 142 of the upstream radial attachment tab 14 comprises two first lugs 17 that each have an orifice 170 configured to receive a first peg 19. Similarly, the second end 162 of the downstream radial attachment tab 16 comprises two second lugs 18 that each have an orifice 180 configured to receive a second peg 20. The first and second lugs 17 and 18 protrude in the radial direction $D_R$ of the turbine ring 1 from the second end 142 of the upstream radial attachment tab 14 and from the second end 162 of the downstream radial attachment tab 16, respectively.

The orifices 170 and 180 may be circular or elongate. Preferably, the set of orifices 170 and 180 includes a portion comprising circular orifices and a portion comprising elongate orifices. The circular orifices make it possible to tangentially index the rings and prevent them from moving tangentially (notably when touched by the vane). The elongate orifices make it possible to adapt to the different expansions of the CMC and the metal. CMC has a coefficient of expansion that is much less than that of metal. In the hot state, the lengths in the tangential direction of the ring sector and of the facing casing portion will thus be different. If there were only circular orifices, the metal casing would impose its movements on the CMC ring, and this would result in very high mechanical stresses in the ring sector. Having elongate holes in the ring assembly allows the peg to slide in this hole and to avoid the phenomenon of overstress mentioned above. Thus, two patterns of holes can be conceived of: a first pattern of holes, for a case with three lugs, would comprise a radial elongate orifice on one radial attachment tab and two tangential elongate orifices on the other radial attachment tab, and a second pattern of holes, for a case having at least four lugs, would comprise a circular orifice and an elongate orifice per facing radial attachment tab in each case. Further similar cases can also be envisioned.

For each ring sector 10, the two first lugs 17 are positioned in two different angular positions with respect to the axis of revolution of the turbine ring 1. Similarly, for each ring sector 10, the two second lugs 18 are positioned in two different angular positions with respect to the axis of revolution of the turbine ring 1.

Each ring sector 10 also comprises rectilinear bearing surfaces 110 that are mounted on the faces of the upstream and downstream radial attachment tabs 14 and 16 in contact with the first tab 33 of the removable annular flange 35 and the annular radial bracket 36, respectively, that is to say on the upstream face 14*a* of the upstream radial attachment tab 14 and on the downstream face 16*b* of the downstream radial attachment tab 16. In a variant, the rectilinear bearing contacts could be mounted on the first tab 33 of the removable annular flange 35 and on the downstream annular radial bracket 36.

The rectilinear bearing contacts 110 make it possible to have controlled sealing zones. Specifically, the bearing surfaces 110 between the upstream radial attachment tab 14 and the first tab 33 of the removable annular flange 35, for the one part, and between the downstream radial attachment tab 16 and the annular radial bracket 36 are contained in one and the same rectilinear plane.

More specifically, having bearing contacts on radial planes makes it possible to do away with the decambering effects in the turbine ring 1.

A method for producing a turbine ring assembly corresponding to the one shown in FIG. 1 will now be described.

Each ring sector 10 described above is produced from ceramic matrix composite (CMC) material by formation of a fiber preform having a shape similar to that of the ring sector and densification of the ring sector by a ceramic matrix.

In order to produce the fiber preform, use can be made of threads made of ceramic fibers, for example threads made of SiC fibers such as those sold by the Japanese company Nippon Carbon under the name "Hi-NicalonS", or threads of carbon fibers.

The fiber preform is beneficially produced by three-dimensional weaving, or multilayer weaving, with arrangement of non-interlinking zones for spacing apart the preform parts corresponding to the tabs 14 and 16 of the sectors 10. The weaving can be of the interlocking type. Other three-dimensional or multilayer woven fabrics can be used, for example multi-layer plain-weave or satin-weave fabrics. Reference may be made to the document WO 2006/136755.

After weaving, the blank can be shaped in order to obtain a ring sector preform which is consolidated and densified by a ceramic matrix, it being possible for the densification to be carried out notably by chemical vapor infiltration (CVI), which is well known per se. In a variant, the textile preform can be hardened slightly by CVI so as to be sufficiently rigid to be manipulated, before passing liquid silicon through the textile by capillary action in order to effect densification ("Melt Infiltration").

A detailed example of the manufacturing of CMC ring sectors is described notably in the document US 2012/0027572.

The ring support structure 3, for its part, is produced from a metal material, such as a Waspaloy® or inconel 718® or C263® alloy.

The production of the turbine ring assembly is continued by mounting the ring sectors 10 on the ring support structure 3.

To this end, the ring sectors 10 are joined together on an annular tool of the "spider" type having, for example, suction cups that are each configured to hold a ring sector 10.

Next, the two second pegs 20 are inserted into the two orifices 3650 provided in the third portion 365 of the annular radial bracket 36 of the ring support structure 3.

The ring 1 is then mounted on the ring support structure 3 by inserting each second peg 20 into each of the orifices 180 in the second lugs 18 of the downstream radial attachment tabs 16 of each ring sector 10 making up the ring 1.

Next, all of the first pegs 19 are placed in the orifices 3540 provided in the second portion 354 of the removable annular flange 35.

Then, the removable annular flange 35 is fastened to the ring support structure 3 and to the ring 1. In order to fasten the removable annular flange 35 to the ring support structure 3, the two attachment hooks 60 and 61 are inserted into the associated compartments 62 and 63 until the shoulder 67 of each hook 60 and 61 comes into abutment against the contour of the compartment 62, 63. In order to hold the ring 1 radially in position, the removable annular flange 35 is fastened to the ring by inserting each first peg 19 into each of the orifices 170 in the first lugs 17 of the upstream radial attachment tabs 14 of each ring sector 10 making up the ring 1.

The ring 1 is then held axially in position with the aid of the removable annular flange 35 and of the annular radial bracket 36 bearing upstream and downstream, respectively, against the rectilinear bearing surfaces 110 of the upstream radial attachment tab 14 and downstream radial attachment tab 16, respectively. During the installation of the removable annular flange 35, an axial prestress can be applied to the first tab 33 of the removable annular flange 35 and to the upstream radial attachment tab 14 in order to remedy the effect of different expansion of the CMC material of the ring 1 and the metal of the ring support structure 3. The removable annular flange 35 is held under axial stress by mechanical elements positioned upstream, as is illustrated by dotted lines in FIG. 4.

The ring 1 is held radially in position with the aid of the first and second pegs 19 and 20 engaging with the first and second lugs 17 and 18 and the orifices 3540 and 3650 of the removable annular flange 35 and of the annular radial bracket 36.

The invention thus provides a turbine ring assembly that makes it possible to hold each ring sector deterministically while allowing the ring sector, and by extension the ring, to deform under the effects of the increases in temperature and variations in pressure, notably independently of the interfacing metal parts, for the one part, and while improving sealing between the sector outside the air passage and the sector in the air passage and by simplifying manipulations and by reducing the number thereof for mounting the ring assembly, for the other part.

The invention claimed is:

1. A turbine ring assembly comprising a ring support structure and a plurality of ring sectors, wherein the plurality of ring sectors form a turbine ring, each ring sector having, in a section plane defined by an axial direction and a radial direction of the turbine ring, a portion forming an annular base with, in the radial direction of the turbine ring, an inside face defining an internal face of the turbine ring and an outside face from which a first and a second attachment tab protrude, the ring support structure having a central annulus and a one-piece annular flange, wherein a first radial tab protrudes from the one-piece annular flange and a second radial tab protrudes from the central annulus, wherein the first and second attachment tabs of each ring sector are held between the first radial tab protruding from the one-piece annular flange and the second radial tab protruding from the central annulus, wherein the one-piece annular flange is fastened in a removable manner to the central annulus of the ring support structure, the annular flange having a first end that is free, a second end coupled to the central annulus of the ring support structure, and a plurality of attachment hooks that protrude from the second end of the annular flange and engage with at least one compartment included in the central annulus of the ring support structure in order to hold the annular flange in position, the annular flange comprising a first and a second attachment hook that each protrude from the second end of the annular flange in the axial direction of the turbine ring, the first and second attachment hooks being spaced apart in the radial direction of the turbine ring, the central annulus of the ring support structure comprising two attachment compartments that engage with the first and second attachment hooks of the annular flange in order to hold the annular flange in position in the radial direction of the turbine ring.

2. The assembly as claimed in claim 1, in which the annular flange comprises a first portion that extends from the first end and a second portion that extends between the first portion and the second end, the first portion comprising separate first and second tabs, the first tab of the first and second tabs bearing against the first attachment tab and the second tab of the first and second tabs being spaced apart from the first tab of the first and second tabs in the axial direction, the second tab of the first and second tabs being upstream of the first tab with respect to the direction of an air flow intended to pass through the turbine ring assembly.

3. The assembly as claimed in claim 1, in which the first and second attachment hooks of the annular flange have two different axial positions in the axial direction of the turbine ring.

4. The assembly as claimed in claim 1, comprising, for each ring sector, at least three pegs for holding the ring sector radially in position, the first and second attachment tabs of each ring sector each comprising a first end integral with the outside face of the annular base, a free second end, at least three lugs for receiving said at least three pegs, at least two lugs of said at least three lugs protruding from the second end of one of the first or second attachment tabs in the radial direction of the turbine ring, and at least one lug of said at least three lugs protruding from the second end of the other attachment tab in the radial direction of the turbine ring, each receiving lug having an orifice for receiving one of the pegs.

5. The assembly as claimed in claim 4, in which a second portion of the annular flange has orifices for receiving one of the pegs, and the second attachment tab comprises an annular bracket having a first portion bearing against the second attachment tab, a second portion that is thinner than the first portion, and a third portion that is positioned between the first and the second portion and has one or more orifices for receiving one of the pegs.

6. The assembly as claimed in claim 1, in which each ring sector comprises rectilinear bearing surfaces on faces of the first and second attachment tabs in contact with the second radial tab and the annular flange, respectively.

7. The assembly as claimed in claim 1, in which, for each ring sector, faces of the second radial tab and of the annular flange in contact with the first and second attachment tabs, respectively, comprise rectilinear bearing surfaces.

8. The assembly as claimed in claim 6, in which each rectilinear bearing surface comprises a recessed groove along an entire length of the bearing surface and a seal fitted in the groove for improving sealing.

9. A turbomachine comprising a turbine ring assembly comprising a ring support structure and a plurality of ring sectors, wherein the plurality of ring sectors form a turbine ring, each ring sector having, in a section plane defined by an axial direction and a radial direction of the turbine ring, a portion forming an annular base with, in the radial direction of the turbine ring, an inside face defining an inside face of the turbine ring and an outside face from which a first and a second attachment tab protrude, the ring support structure having a central annulus and a one-piece annular flange, wherein a first radial tab protrudes from the one-piece annular flange and a second radial tab protrudes from the central annulus, wherein the first and second attachment tabs of each ring sector are held between the first radial tab protruding from the one-piece annular flange and the second radial tab protruding from the central annulus, wherein the one-piece annular flange is fastened in a removable manner to the central annulus of the ring support structure, the annular flange having a free first end, a second end coupled to the central annulus of the ring support structure, and a plurality of attachment hooks that protrude from the second end of the annular flange and engage with at least one compartment included in the central annulus of the ring support structure in order to hold the annular flange in position, the annular flange comprising a first and a second attachment hook that each protrude from the second end of the annular flange in the axial direction of the turbine ring, the first and second attachment hooks being spaced apart in the radial direction of the turbine ring, the central annulus of the ring support structure comprising two attachment compartments that engage with the first and second attachment hooks of the annular flange in order to hold the annular flange in position in the radial direction of the turbine ring.

* * * * *